United States Patent [19]

Lewkowitz

[11] Patent Number: 5,018,330

[45] Date of Patent: May 28, 1991

[54] DOOR LIGHT

[76] Inventor: Bernd Lewkowitz, English Creek and West Jersey Ave., McKee City, N.J. 08232

[21] Appl. No.: 472,726

[22] Filed: Jan. 31, 1990

[51] Int. Cl.[5] ..... E06B 3/58

[52] U.S. Cl. ..... 52/455

[58] Field of Search ..... 52/455–458, 52/767, 209, 208, 771

[56] References Cited

U.S. PATENT DOCUMENTS

| | | | |
|---|---|---|---|
| 304,183 | 8/1884 | Davis | 52/209 |
| 3,903,669 | 9/1975 | Pease et al. | 52/455 |
| 4,655,025 | 4/1987 | Marinoni | 52/771 |
| 4,882,877 | 11/1989 | Guetle et al. | 52/456 |
| 4,914,888 | 4/1990 | Hanson | 52/767 |

FOREIGN PATENT DOCUMENTS

| | | | |
|---|---|---|---|
| 276345 | 10/1951 | Switzerland | 52/208 |

*Primary Examiner*—James L. Ridgill, Jr.
*Attorney, Agent, or Firm*—Eckert Seamans Cherin & Mellott

[57] ABSTRACT

A door light for use with a residential or commercial exterior door is disclosed. A plurality of glass holding clips are peripherally spaced about the door opening to position and secure a pane of glass within the door opening. Each clip includes mating interior and exterior members and the members are secured together by threaded fasteners which insert through aligned openings in the clip members. The interior and exterior clip members are provided with at least a pair of spaced projections. Interior and exterior decorative frames peripherally overfit the interior and exterior peripheries of the door opening. The decorative frames are provided with recesses or grooves in alignment with the clip member projections to permit snap-on attachment of the decorative frames over the clip members in a manner to completely shield the clip members and the fasteners. A bottom moisture shield overfits the bottom of the door opening and is provided with flats to receive the bottom clips therein to continuously expel moisture from the door light without interfering with the operation of the clip members.

17 Claims, 3 Drawing Sheets

DOOR LIGHT

BACKGROUND OF THE INVENTION

1. Field of the Invention

The present invention relates generally to the field of exterior doors for residential and commercial constructions, and more particularly, relates to an improved door light or insert for use in conjunction with such exterior doors.

2. Background of the Invention

At the present time, various sizes and shapes of door lights are provided by manufacturers of wooden and steel exterior doors both to provide a decorative trim and to allow a degree of visibility or light through an otherwise completely opaque building construction member. Especially when employing steel doors, it is now the common practice to form an opening in the door of the desired shape, configuration, dimensions and location at the time of manufacture and then to provide a cooperating door light to close and protect the opening thus provided. The door light may be applied to the door construction either at the door manufacturing plant or directly on the job site at the time of installation.

Presently, the door light constructions are manufactured by employing two substantially identical, peripheral, mating halves or door light frames which straddle and hold the glass in position. The door light frame members secure directly to the door completely about the previously formed door opening. The cooperating mating half sections may be fabricated of wood or of suitable plastic material, for example, foamed vinyl or high impact styrene and can be formed of any previously selected, desired, cross sectional configuration or profile.

The mating half sections must be secured together to form a complete, secure door insert and a series of peripherally spaced screws or other fasteners are generally employed for this purpose. Inasmuch as the door light is intended for installation in an exterior door, the directing of such fasteners inwardly from the outer frame half section to attach to the inner frame half section would inherently present a considerable security problem. Accordingly, the existing fasteners are always driven from the inside and are therefore visible from the interior of the house or other building. Such visible screw heads or fastener openings detract from the overall pleasing finished appearance of the door light. The need therefore remains to provide a secure and decorative door light construction without employing fasteners which are fully visible from the interior of the residence or commercial establishment.

SUMMARY OF THE INVENTION

The present invention relates generally to the field of exterior door constructions, and more particularly, is directed to a novel door light for use within an exterior door wherein all of the fastening members are covered by the door light components and are completely hidden from view.

A plurality of peripherally spaced, hidden, plastic clips are employed about a door opening to secure the glass, either single pane or double pane insulated glass within the shaped opening formed in the door at the time of manufacture. The clips comprise similar, mating, interior and exterior members having aligned openings provided therein. A threaded fastener, for example, a long screw, positions within the aligned openings to secure the clip interior and exterior members together. Sufficient clips are employed at spaced locations about the opening to structurally secure the glass pane or panes within the door opening.

Each of the clip interior and exterior members is molded or otherwise formed of suitable plastic material to the required dimensions and is generally L-shaped in configuration. The long leg of each L-shaped clip member overfits the peripheral surface defining of the door opening and the shorter leg of each clip member aligns over either an interior surface or an exterior surface of the door. Each of the legs of the clip members or half sections is provided with an outwardly extending tab or projection to form a convenient place of attachment for a peripheral, decorative, interior or exterior door light frame. The interior and exterior door light frames or cover can be substantially identically formed to provide a decorative, finished appearance, both interiorly and exteriorly about the door light glass panel when the door light of the present invention is completely installed.

Each of the interior and exterior, decorative, door light frames preferably can be molded or otherwise formed of a hard vinyl of suitable composition to resist deformation under all normal conditions of heat or cold when the door light is in use. The peripheral door light frames include indentations or grooves in alignment with the tabs projecting from the first and second clip member legs to provide a snap on assembly in an extremely simple and speedy construction procedure. A novel moisture barrier shield has been developed for use with the clips to direct any moisture which may have a tendency to collect at the bottom of the opening exteriorly of the door.

After the interior and exterior door light frames have been snapped over the mating clip members, it will be appreciated that a complete, cooperating, interior and exterior, decorative door light construction will be formed wherein all of the structural members including the clips and the associated fasteners will be fully covered by the decorative door-light frames. Thus it will be seen that the former problem inherent in the prior art door lights which required that the fasteners be visible from the building interior has now been completely overcome in an improved, extremely simple and inexpensive door light construction.

It is therefore an object of the present invention to provide an improved door light of the type set forth.

It is another object of the present invention to provide a novel door light comprising a plurality of peripherally positioned clips to secure a pane of glass within a door opening in combination with similar interior and exterior peripheral frames which snap upon the clips to form decorative, interior and exterior peripheral constructions which completely overfit and hide all clips, fasteners, holes or other objectional door light construction features.

It is another object of the present invention to provide a novel door light for installation within an opening in an exterior door which comprises a plurality of glass holding clips, each clip having an interior member and an exterior member, the clip members being joined by suitable threaded fasteners, the mating clip members each being provided with upper and lower tabs, an exterior peripheral, decorative frame having slots or grooves in alignment with some of the tabs, an interior peripheral, decorative frame having slots or grooves in alignment with other of the clip tabs whereby the interior and exterior peripheral, decorative frames can be secured to the door about the opening in a manner to completely shield and hide the clips and fasteners.

It is another object of the present invention to provide a novel door light that is simple in design, inexpensive in manufacture and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 1:
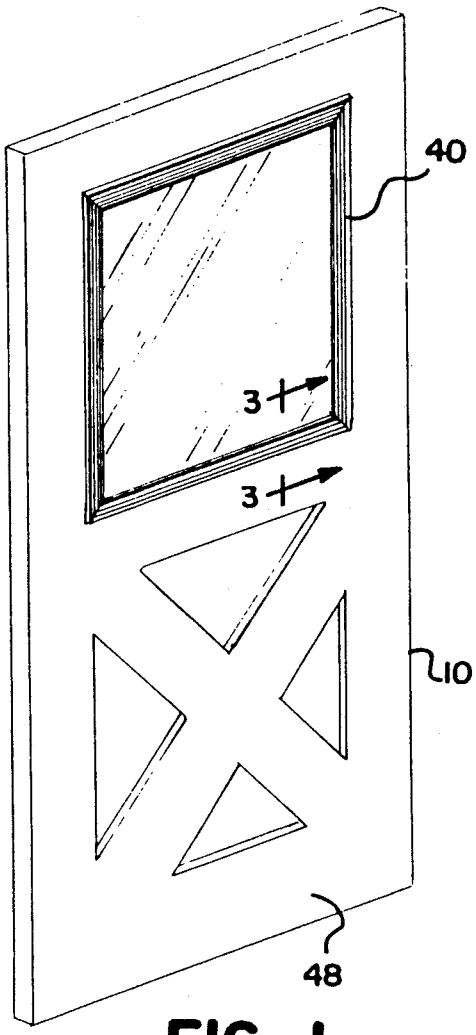
FIG. 1 is a perspective view of a door with a door light constructed and installed therewithin in accordance with the present invention.

Although specific terms are used in the following description for the sake of clarity, these terms are intended to refer only to the particular structure of the invention selected for illustration in the drawings, and are not intended to define or limit the scope of the invention.

Figure 2:
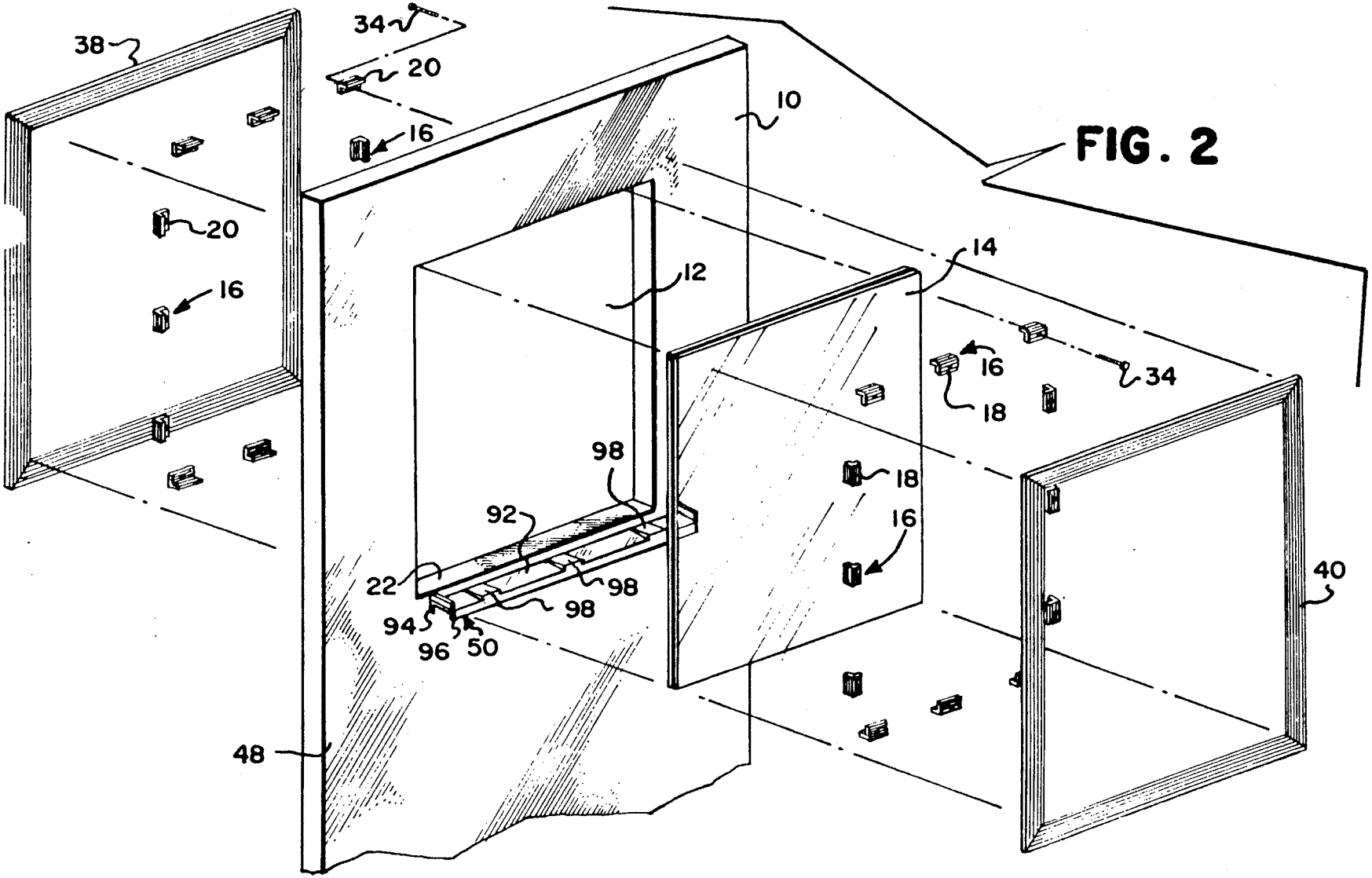
FIG. 2 is an enlarged, exploded, perspective view of the door light and door of FIG. 1.

Referring now to the drawings, there is shown in FIGS. 1 and 2 an exterior door 10 which may be of metal or wood in accordance with construction techniques well known to those skilled in the art. The door 10 is provided with a shaped opening 12 which may be of any desired configuration, for example, square, rectangular, circular, oval, etc. depending upon the door design as dictated by the wishes of the owner and the architectural features of the remaining portions of the building upon which the door 10 will be installed. A light of glass 14 of size and configuration to fit within the shaped opening 12 is provided and the glass light may be either a single pane of glass or a double, insulated glass combination as desired and as well known to those skilled in the art. Optionally, wooden or plastic grill bars (not shown) may be secured over the surface of the glass light 14 in well known manner to give the visual appearance of a divided window construction.

Figure 3:
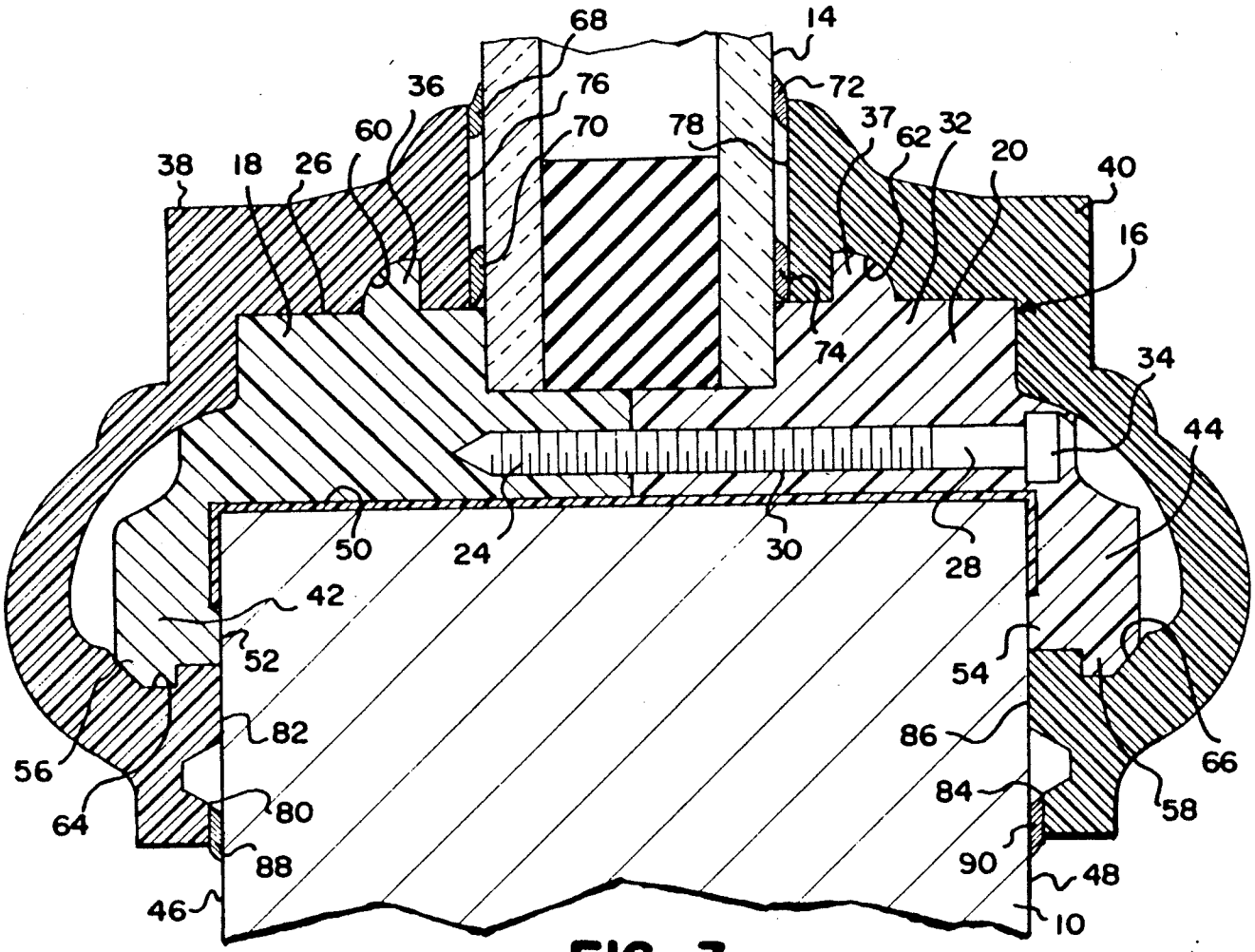
FIG. 3 is an enlarged, cross-sectional view taken along line 3—3 on FIG. 1, looking in the direction of the arrows.
Figure 4:
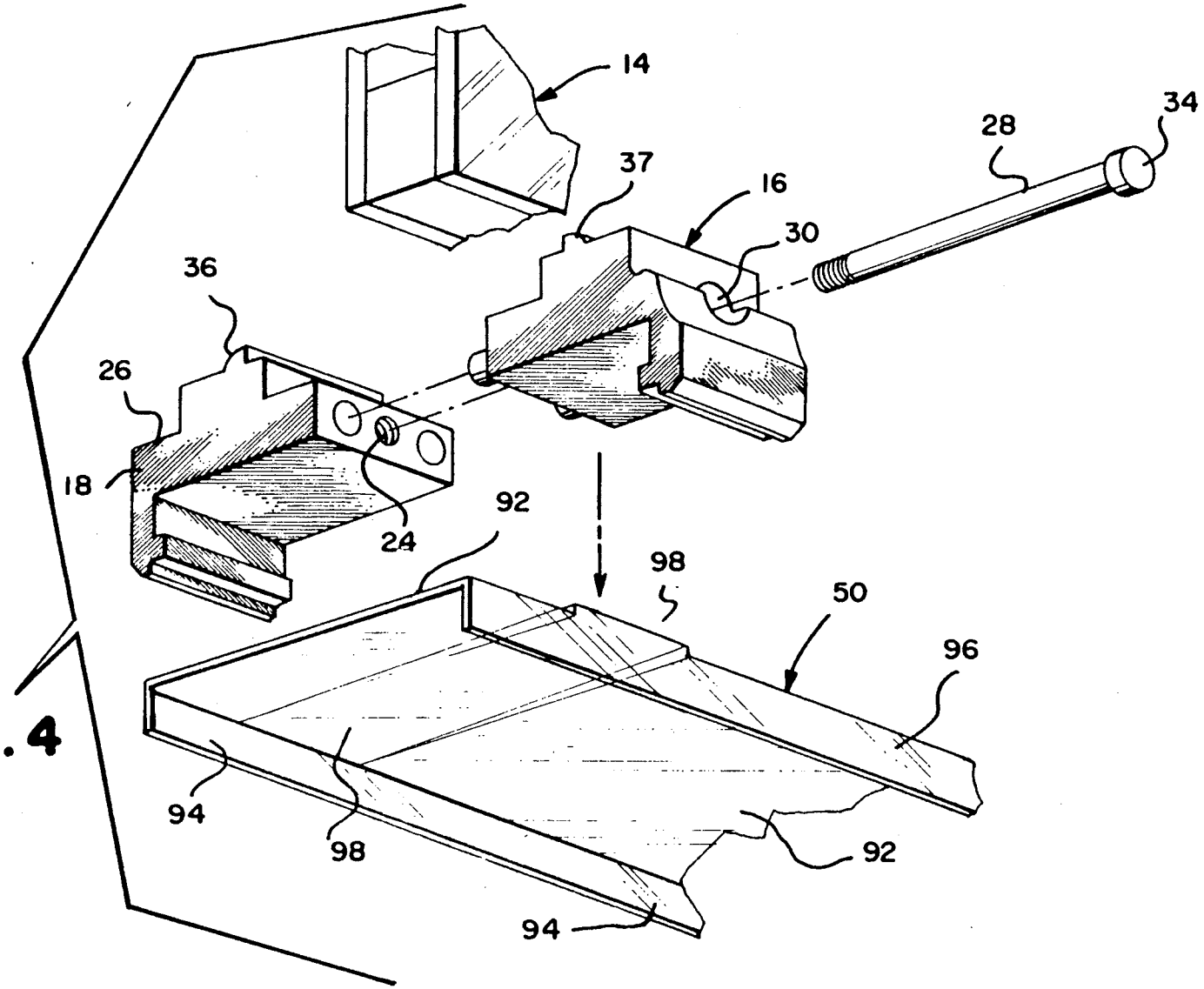
FIG. 4 is a perspective view of a clip for holding the glass within the door opening in accordance with the present invention and showing a part of the bottom moisture barrier shield.

Still referring to FIG. 2, and further considering FIGS. 3 and 4, a plurality of peripherally spaced, identical clips 16 are strategically placed about the door light opening 12 to securely hold the glass pane or light 14 in position within the opening 12. As best seen in FIG. 3, each clip 16 comprises a pair of cooperating, similarly formed, interior and exterior members 20, 18 which are designed for closely overfitting the peripheral door construction 22 which defines the shaped opening 12.

The interior or first clip member 20 and the exterior or second clip member 18 are each generally L-shaped in configuration and are formed to substantially the same dimensions and shape. The clip member 18 comprises a first, long leg 26 and a shorter leg 42, the legs 26,42 being arranged at right angles. Similarly, the mating clip member 20 comprises a first, long leg 32 and a shorter leg 44, the legs 32,44 being arranged at right angles. The long clip legs 26,32 overlie the edge 22 which defines the opening 12. One clip member, for example the second clip member 18 is formed with an interiorly facing opening 24 of length less than the length of the long clip leg 26 to receive therein in threaded engagement a suitable metallic threaded fastener 28. It will be noted that the short opening 24 is shorter in length than the length of the clip leg 26 to thereby provide a suitable recess or socket to threadedly engage and secure to the fastener 28.

The first clip member 20 primarily differs from the second clip member 18 in that an elongated opening 30 is provided completely through the longer leg 32 of the first clip member 20. The elongated opening 30 is drilled or otherwise formed of sufficient diameter to receive therethrough the entire length of the threaded fastener 28. The fastener 28 may thus be employed to securely fasten the mating clip members 18, 20 together to position and to secure the glass light 14 within the shaped opening 12. If desired, and preferably, the outer end of the elongated opening 30 is enlarged to recess the threaded fastener head 34 therewithin so as to provide a smooth outer periphery for the clip member 20 and to assure full seating of the fastener 28 within the shorter opening 24 of the second clip member 18.

The long legs 26, 32 of the respective first and second clip members 18, 20 are each provided with an integral, upwardly extending, connecting tab 36, 37 to facilitate attachment of the respective first and second door light frames 38, 40 as hereinafter more fully set forth. The short legs 42, 44 of the clip members 18,20 respectively overlie an interior face 46 or an exterior face 48 of the door construction 10. Each short clip leg 42, 44 comprises a contact surface 52, 54 to bear against and secure upon an interior or exterior door surface 46, 48 to provide a firm and rugged construction to secure the interior and exterior door light frames 38, 40. The short clip legs 42, 44 each comprise a downwardly extending projection or tab 56, 58. The tabs 56, 58 respectively interconnect a portion of a door light frame 38, 40 in a manner to secure the door light frame halves 38, 40 over the interior and exterior surfaces 46, 48 of the door 10 in a manner to completely shield and hide the plurality of spaced, interior clips 16.

Still referring to FIG. 3, and further considering FIGS. 1 and 2, the door light frames 38, 40 are similarly and oppositely formed to provide a decorative, aesthetically pleasing, peripheral cover or shield about the entire interior and exterior periphery of the door opening 12. The door light frames 38, 40 are preferably molded or otherwise formed in known manner of high density vinyl or other suitable hard plastic material of configuration necessary to overfit and cover the periphery of the door opening 12 and the plurality of glass light holding clips 16. Each door light frame 38, 40 is provided with an upper indentation or groove 60, 62 of suitable size, shape and position to receive therein and to interlock with a respective connecting tab 36, 37 which upwardly extends from a long leg 26, 32 of the first and second clip members 20, 18. Similarly, the door light frames 38, 40 are formed to provide a similar, opposite, lower indentation or indentations or grooves 64, 66 of size, location and configuration to receive therein and to interlock with a lower projection or tab 56, 58 which extends from a shorter clip leg 42, 44.

The door light frames 38, 40 terminate upwardly in glass bearing surfaces 76, 78, which surfaces align in parallel relationship with the glass light 14 when the frames are properly installed. Pairs of vertically spaced, peripheral gaskets 68, 70 and 72, 74 of soft vinyl or other suitable soft material connect to the surfaces 76, 78 and may be integrally formed therewith in known manner. The gaskets 68, 70, 72, 74 provide a water-tight seal between the door light frames 38, 40 and the interior and exterior surfaces of the glass light 14. The door light frames 38, 40 terminate downwardly in door bearing surfaces 80, 82 and 84, 86. At least the lower bearing surfaces 80, 84 carry sealing gaskets 88, 90, which gaskets may be fabricated of soft vinyl or other suitable moisture sealing material. When the door light frames 38, 40 are properly seated and secured upon the connecting tabs or projections 36, 37 and 56, 58 of a plurality of clips, the frame members will be respectively sealed against the glass light 14 by the peripheral soft vinyl gaskets 68, 70, 72 and 74 and against the door construction itself by the soft vinyl sealing gaskets 88, 90.

Referring now to FIGS. 2 and 4, in a preferred type of installation, a lower moisture barrier or shield 50 is provided and is secured over the door edge 22 which defines the lower extent of the shaped opening 12. The moisture shield 50 additionally aids in repelling moisture when the door light of the present invention is in use. As shown, the moisture shield 50 is generally web-shaped in cross-sectional configuration and comprises a first, longer leg 94, a second, shorter leg 96 and a sloping top surface or web 92 extending between the first leg 94 and the second leg 96. The moisture shield 50 is constructed of sufficient length to span completely across the bottom edge 22 of the shaped opening 12. As illustrated, the top surface 92 slopes gently from the interior door face 46 downwardly toward the exterior door face 48. In this manner, any moisture that may enter the system through and about the vinyl gaskets 68, 70, 72, 74 or elsewhere, will impinge upon the top moisture shield surface 92 to thereby be conducted continuously and automatically exteriorly of the door 10.

As illustrated, the moisture barrier or shield 50 includes a plurality of horizontal clip flats 98 of size and position to receive therein respectively a glass light retaining clip 16. In this manner, the clips 16 which are applied over the bottom edge 22 which defines the lowest extent of the door opening can be applied in horizontal alignment over the edge so that the moisture shield will not in any way affect or otherwise interfere with the function and operation of the bottom plurality of clips 16.

Although the invention has been described with a certain degree of particularity, it is understood that the present disclosure has been made only by way of example and that numerous changes in the details of construction and the combination and arrangement of parts maybe resorted to without departing from the spirit and scope of the invention. Thus, the scope of the invention should not be limited by the foregoing specification, but rather only by the scope of the claims appended hereto.

What is claimed is:

1. A door light for installation in a door of the type having an interior surface, an exterior surface, a shaped opening provided in the door and defining a periphery, and glass within the opening, the door light comprising:

a plurality of clips securing the glass to the door within the opening, each said clip being a discrete fastening element and comprising:

a first member and a second member, the first and second members contacting opposite sides of the glass, each clip member comprising a first leg overfitting the periphery of the door opening and a second leg in contact with one of said glass surfaces, the first leg of the first clip member being provided with a first hole, the first leg of the second clip member being provided with a second hole;

a fastener connecting the first clip member to the second clip member;

first and second door light frames peripherally overfitting the shaped opening on opposite sides of the door, each of the door light frames comprising an integral one piece molding of plastic fitted around the periphery defined by the shaped opening in the door, and each of the door light frames being respectively secured to one of said first clip member and said second clip member, the door light frames and the respective first and second clip members defining protrusions having abutments, and complementary recesses which interfit with the protrusions, to lock the door light frames to the first and second clip members inwardly toward the door and the glass, the protrusions being directed in opposite directions along surfaces of the door and the glass, thereby fixing the door light frames to the door while permitting expansion and contraction of the door light frames relative to the door.

2. The door light of claim 1 wherein the door light frames comprise rigid portions and first and second resilient portions, the first resilient portions contacting the glass to act as a first moisture seal.

3. The door light of claim 2 wherein the second resilient portions contact a said surface of the door to act as a second moisture seal.

4. The door light of claim 1 wherein the first and second holes are positioned in axial alignment.

5. The door light of claim 4 wherein the fastener is positioned within the aligned holes.

6. The door light of claim 5 wherein the fastener is threaded and wherein the fastener is threadedly engaged in one of the holes.

7. The door light of claim 6 wherein the first hole is shorter in length than the second hole and wherein the fastener is engaged within the first hole.

8. The door light of claim 1 wherein the opening comprises a bottom edge and a moisture shield overfitting the said bottom edge.

9. The door light of claim 8 wherein the moisture shield extends in length sufficiently to span the entire width of the bottom edge.

10. The door light of claim 9 wherein the width of the clip is less than the width of the bottom edge.

11. The door light of claim 10 wherein the moisture shield is generally U-shaped in cross section and comprises a first leg, a second leg spaced from the first leg and a moisture resistant web interconnecting the first and second legs, substantially the entire web sloping downwardly from the said door interior surface towards the said door exterior surface.

12. The door light of claim 11 wherein the web comprises a clip flat to receive the clip, the clip flat being parallel to the said bottom edge, the clip flat not sloping downwardly from the said interior surface towards the said exterior surface.

13. A door light for installation within an opening through a door, the door defining an interior and an exterior, the door light comprising:

a plurality of glass holding clips spaced about the door opening, each clip having an interior clip member and an exterior clip member, the clip members being joined by fasteners, the clip members each being provided with an upper tab and a lower tab;

an exterior peripheral, decorative frame secured to the clips, the exterior decorative frame including an integrally molded plastic frame extending around a periphery of the opening, the exterior frame having recesses in alignment with the tabs of the exterior clip member; and, an interior peripheral, decorative frame secured to the clips, the interior decorative frame having recesses in alignment with the tabs of the interior clip member, the interior and exterior peripheral decorative frames overfitting the clips, whereby the interior and exterior peripheral, decorative frames can be secured to the door about the opening in a manner to cover the clips and fasteners, the upper tab and the lower tab defining abutments substantially parallel to a surface of the door, and the decorative frames having complementary recesses which interfit with the tabs, to lock the decorative frames to the interior and exterior clip members inwardly toward the door, the tabs being oriented in opposite directions along surfaces of the door, thereby fixing the decorative frames to the door while permitting expansion and contraction of the decorative frames relative to the door.

14. The door light of claim 13 wherein the door opening comprises a bottom edge and a moisture shield overfitting the bottom edge, the moisture shield comprising a web extending over the bottom edge, the web being in angular relationship to the bottom edge to drain moisture away from the door opening, the web being provided with a plurality of clip flats, each clip flat receiving a glass holding clip therein.

15. The door light of claim 13 wherein the interior and exterior clip members are provided with aligned holes, the holes in the interior clip members extending entirely through the interior clip member, the holes in the exterior clip members being shorter than the length of an exterior clip member, the said fasteners extending through the interior clip members and being secured in the exterior clip members.

16. The door light of claim 15 wherein the door opening comprises a bottom edge and a moisture shield overfitting the bottom edge, the moisture shield comprising a web extending over the bottom edge, the web being in angular relationship to the bottom edge to drain moisture away form the door opening, the web being provided with a plurality of clip flats, each clip flat receiving a glass holding clip therein.

17. The door light of claim 16 wherein the clip flats are positioned in parallel alignment over the bottom edge of the door opening.

* * * * *